US007694544B2

(12) United States Patent
Krumpen et al.

(10) Patent No.: US 7,694,544 B2
(45) Date of Patent: Apr. 13, 2010

(54) PRESSING DEVICE FOR FORMING STEEL SHEET BLANKS INTO CLIPS

(75) Inventors: Helmut Krumpen, Grossenkneten (DE); Frank Spehling, Kirchlinteln (DE)

(73) Assignee: Airbus Operations GmbH, Hamburg (DE)

( * ) Notice: Subject to any disclaimer, the term of this patent is extended or adjusted under 35 U.S.C. 154(b) by 113 days.

(21) Appl. No.: 12/070,388

(22) Filed: Feb. 15, 2008

(65) Prior Publication Data

US 2008/0202192 A1 Aug. 28, 2008

(30) Foreign Application Priority Data

Feb. 15, 2007 (DE) ..... 10 2007 007 516

(51) Int. Cl.
*B21D 5/02* (2006.01)

(52) U.S. Cl. ..... 72/384; 72/389.3; 72/389.6; 72/412; 72/472

(58) Field of Classification Search ..... 72/319, 72/320, 384, 389.3, 389.6, 412, 446, 470, 72/472, 477
See application file for complete search history.

(56) References Cited

U.S. PATENT DOCUMENTS 3,509,757 A * 5/1970 Hanni ..... 72/414
3,681,994 A * 8/1972 Zbornik ..... 72/389.3
4,509,357 A * 4/1985 Zbornik ..... 72/384
4,510,789 A * 4/1985 Tomioka et al. ..... 72/442

FOREIGN PATENT DOCUMENTS

| | | |
|---|---|---|
| CH | 425701 | 12/1966 |
| DE | 2844867 | 4/1980 |
| DE | 218845 | 2/1985 |

OTHER PUBLICATIONS

German Office Action dated Nov. 9, 2007.

* cited by examiner

*Primary Examiner*—David B Jones
(74) *Attorney, Agent, or Firm*—Jenkins, Wilson, Taylor & Hunt, P.A.

(57) ABSTRACT

A pressing device for forming steel sheet blanks into clips, which comprise curved planking elements and rectilinear stringer elements for connecting a fuselage cell skin to a stringer and to an annular rib in an aircraft fuselage, comprises at least one curved upper tool, at least one curved lower tool, at least one rectilinear upper tool, and at least one rectilinear lower tool. A steel sheet blank is receivable and formable between the at least one curved upper and lower tools and the at least one rectilinear upper and lower tools. The at least one curved upper and lower tool each comprises an upper and lower convexity surface designed to essentially correspond to each other in order to form the curved planking element in a single stroke surface model forming process by simultaneously bending and stamping. The at least one rectilinear upper tool and the at least one rectilinear lower tool each comprises an upper and lower bending surface designed to correspond to each other in order to form the rectilinear stringer element.

7 Claims, 4 Drawing Sheets

PRESSING DEVICE FOR FORMING STEEL SHEET BLANKS INTO CLIPS

CROSS-REFERENCE TO RELATED APPLICATIONS

This application claims the benefit of German Application No. 10 2007 007 516.4, filed Feb. 15, 2007, the disclosure of which is herein incorporated by reference.

BACKGROUND OF THE INVENTION

The invention relates to a pressing device for forming steel sheet blanks into clips, which comprise curved planking elements and rectilinear stringer elements, for connecting a fuselage cell skin to a stringer and an annular rib in an aircraft fuselage.

The fuselage cell of an aircraft is generally formed from a large number of fuselage barrels arranged behind each other and connected to each other in the sectional design still used conventionally. The fuselage barrels are formed with a large number of annular ribs spaced relative to each other. The ribs are planked with curved aluminum alloy sheet for the formation of the fuselage cell skin. A large number of reinforcing profiles ("stringers") are arranged parallel to the longitudinal extension of the fuselage barrel on the inner surface of the fuselage cell skin such that they are uniformly spaced around the circumference. The mechanical connection between the stringers, the annular ribs and the fuselage skin is made by means of clips. The clips have a rectilinear stringer element for contact with the stringers and a planking element for contact with the curved fuselage cell skin.

Conventional clips are produced from a cut flat steel sheet blank of an aluminum alloy material in two bending steps. Forming is carried out by means of a rubber forming tool or with a membrane tool. Before the actual forming process, the steel sheet blanks are first soft annealed to guarantee easy mechanical deformability. After the two-stage forming process, the formed steel sheet blanks are solution heat treated in order to regain the required mechanical strengths. This is followed by further machining steps, such as application of the surface protection.

A disadvantage of existing production methods and the devices used for them is the relative large number of production steps, the low degree of automation and the thermal pre- and post-treatment of the steel sheet blanks previously required.

BRIEF SUMMARY OF THE INVENTION

The invention provides a pressing device for forming steel sheet blanks into clips, which comprise curved planking elements and rectilinear stringer elements for connecting a fuselage cell skin to a stringer and to an annular rib in an aircraft fuselage, comprises at least one curved upper tool, at least one curved lower tool, at least one rectilinear upper tool, and at least one rectilinear lower tool. A steel sheet blank is receivable and formable between the at least one curved upper and lower tools and the at least one rectilinear upper and lower tools. The at least one curved upper and lower tools each comprises an upper and lower convexity surface designed to essentially correspond to each other in order to form the curved planking element in a single stroke surface model forming process by simultaneously bending and stamping. The at least one rectilinear upper tool and the at least one rectilinear lower tool each comprises an upper and lower bending surface designed to correspond to each other in order to form the rectilinear stringer element.

Since the at least one curved upper tool and the at least one curved lower tool each comprises an upper and lower convexity surface designed to essentially correspond to each other, and since the at least one rectilinear upper tool and the at least one rectilinear lower tool each comprise an upper and lower bending surface corresponding essentially to each other and for forming the rectilinear stringer element, the curved planking element and the rectilinear stringer element are formed simultaneously, i.e. in one stroke, in the case of two steel sheet blanks. The steel sheet blanks are then replaced in the tools to form the missing angle in a second working step.

The curved upper and lower tools enable the formation of a "curved" angle on the clip—which is adapted to the contour of the aircraft fuselage and the fuselage cell skin—in a combined "bending and stamping process". This combined "bending and stamping process" is referred to below as "surface model forming process". Only the rectilinear (flat) stringer element is formed on the steel sheet blank by a pure bending process with the rectilinear upper and lower tools.

The pressing device may comprise three curved upper and lower tools and at least three rectilinear upper and lower tools. This enables a stringer element or a planking element to be formed on at least six steel sheet blanks simultaneously.

At least one upper and lower tool may each comprise an upper and a lower convexity surface. This enables the curved planking element to be formed on the steel sheet blank in a single-stroke surface model forming process (combined stamping and bending).

DETAILED DESCRIPTION OF THE INVENTION

Figure 1:
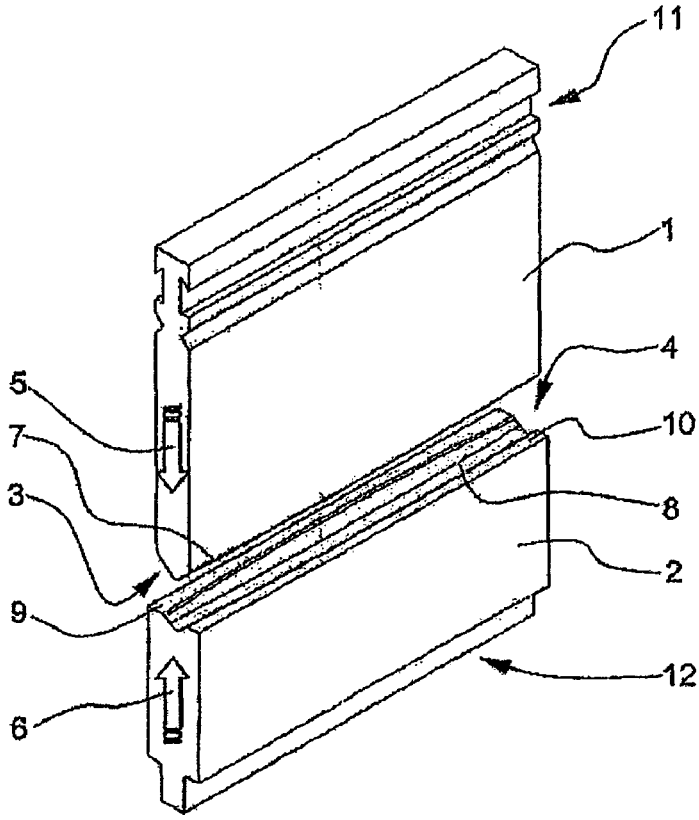
FIG. 1 is a perspective view of a curved upper and lower tool.

In the drawings, same design elements are provided with the same reference numbers.

FIG. 1 shows a perspective view of a curved upper tool 1 and a curved lower tool 2. The upper tool 1 and lower tool 2 each have an essentially cuboid geometric shape.

There is an upper convexity surface 3 at the lower end of the curved upper tool 1, whilst there is a lower convexity surface 4 at the other end of the curved lower tool 2. The flat sheet blank, initially still flat and not shown in FIG. 1, is received between the convexity surfaces 3, 4 during the forming process. The actual forming process of the sheet blank is carried out by means of a pressing device (cf. FIG. 6) not shown in the representation in FIG. 1 either, by means of which device the upper tool 1 and/or lower tool 2 are pressed together in the direction of the arrows 5, 6 with a high mechanical pressing force. The upper and lower tool 1, 2 shown in FIG. 1 serve to form the curved planking element on the steel sheet blank. The steel sheet blank is formed on the basis of the spherically curved convexity surfaces 3, 4 by a combined bending and stamping process, the so-called surface model forming process.

The convexity surfaces 3, 4 are designed so that the curved planking element of the clip to be produced from the steel sheet blank is stamped or bent in a first forming step.

The upper convexity surface 3 has a height curve 7 whose surface model ("curvature" or "curvature curve" corresponds essentially to the curvature of the planning element of the clip. Moreover, the upper convexity surface 3 has further height curves with slightly different processes which, for greater clarity of the drawings, are not provided with a reference number. All height curves lie in the convexity surface 3 or form them.

Accordingly, the curved lower tool 2 has a lower convexity surface 4 with a base curve 8, whose surface model ("curvature" or "curvature curve") in turn corresponds essentially to the curvature of the planking element to be formed. Furthermore, the lower convexity surface 4 has further base curves with slightly different processes which, for better clarity of the drawing, are not provided with a reference number. All the base curves lie in the lower convexity surface 4 or form them.

The surface geometry of the upper convexity surface 3 and the lower convexity surface 4 are designed so that they correspond essentially to each other (complementary), i.e. a positive connection can be made between the convexity surfaces 3, 4, at least in certain regions. Furthermore, the two flat surfaces 9, 10 lie adjacent to both sides of the lower convexity surface 4.

Furthermore, the upper tool 1 and the lower tool 2 have fastening mechanisms 11, 12 with which the upper and lower tools 1, 2 can be fastened in the pressing device. The fastening mechanisms 11, 12 may, for example, be designed as grooves arranged on both sides on the upper and lower tools 1, 2. The grooves may be designed as so-called dovetail grooves. Thus, additional fastening means, clamping screws or the like, for example, may be dispensed with.

Figure 2:
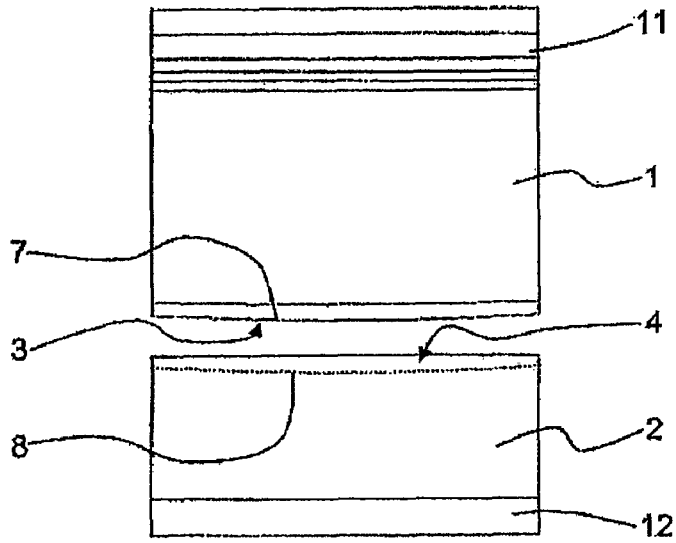
FIG. 2 is an elevation view of a curved upper and lower tool.

FIG. 2 shows an elevation view of the upper tool 1 and lower tool 2. The height curve 7 of the upper convexity surface 3 of the upper tool 1 runs essentially parallel with the base curve 8 of the lower convexity surface 4 of the lower tool 2. The convexity surfaces 3, 4 are eventually designed so that they correspond essentially to each other. This means that in order to achieve optimum stamping or bending of the curved planking element of the clip, which is matched exactly to the contour of the fuselage cell skin within the required tolerances, defined contour deviations can be provided between the upper and lower convexity surfaces 3, 4. A positive connection between the convexity surfaces 3, 4 is—if at all—present in certain regions in any case. In the embodiment shown, the fastening mechanisms 11, 12 are designed as longitudinal grooves which are each inserted in the ends of the upper and lower tools 1, 2 pointing away from the convexity surfaces 3, 4.

Figure 3:
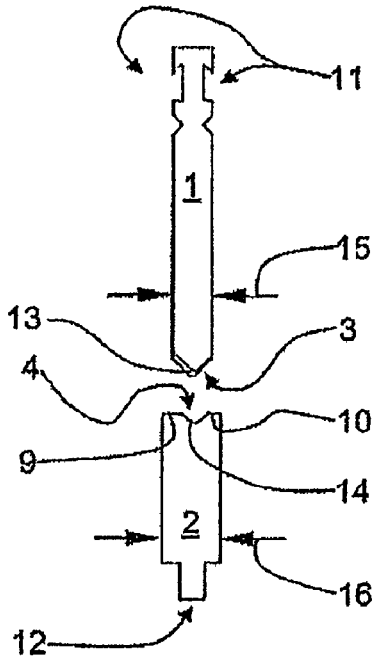
FIG. 3 is a side view of a curved upper and lower tool.

FIG. 3 shows a side view of the upper and lower tools 1, 2 with the upper convexity surface 3 and the lower convexity surface 4. The convexity surfaces 3, 4 are designed so that they correspond essentially to each other and have an approximately V-shaped cross-sectional geometry at least in the edge region of the upper and lower tools 1, 2. However, the cross-sectional geometry of the upper and lower tools 1, 2 varies constantly along the longitudinal extension in the lower and upper regions respectively, due to the locally varying curvature of the convexity surfaces 3, 4, and may deviate in these regions from the approximately V-shaped cross-sectional geometry shown. The flat surfaces 9, 10 of the lower tool 2 are connected to both sides of the lower convexity surface 4. A width 15 of the upper tool 1 is also less than a width 16 of the lower tool 2. The fastening mechanism 11 is designed as a dovetail groove on both sides, whilst the lower fastening mechanism 12 is designed as a rectangular groove on both sides.

Figure 4:
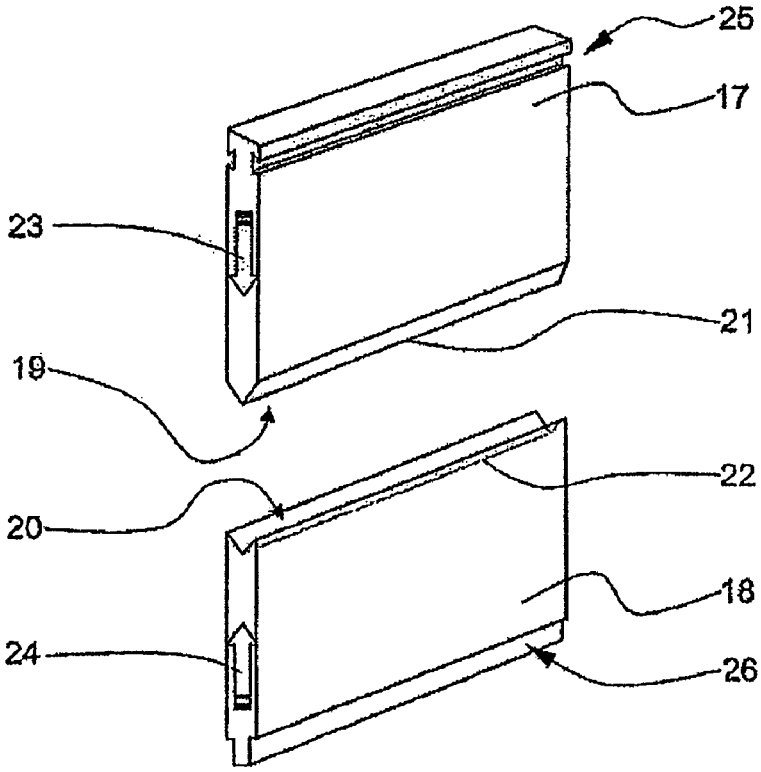
FIG. 4 is a perspective view of a rectilinear upper and lower tool.

FIG. 4 shows a perspective view of a rectilinear upper and lower tool 17, 18 with an upper and lower bending surface 19, 20, which are arranged on a lower end of the upper tool 17 or an upper end of the lower tool 18.

Unlike the curved upper and lower tools 1, 2 shown in FIGS. 1 to 3, the steel sheet blank is formed by means of a pure bending process along a straight bending line by means of the upper and lower tools 17, 18 as shown in FIG. 4. The upper and lower tools 17, 18 serve to form a rectilinear (flat) element on the steel sheet blank to form the so-called "stringer element" on the clip. An upper bending surface 19 has a rectilinear height line 21, whilst a lower bending surface 20 has a rectilinear baseline 22. The geometric shape of the bending surfaces 19, 20 remains constant along the longitudinal extension of the upper and lower tools 17, 18, unlike the curved tools 1, 2. The process of forming of a steel sheet blank arranged between the upper tool 17 and lower tool 18 is initiated by pressing the upper tool 17 by means of a pressing device not shown in FIG. 4 by applying high mechanical pressure. Alternatively the lower tool 18 alone, or the upper and lower tools 17, 18 are simultaneously moved. Furthermore, both the upper tool 17 and the lower tool 18—just as curved upper and lower tools 1, 2, as shown in FIGS. 1 to 3—each has a fastening mechanism 25, 26 for receiving the upper and lower tools 17, 18 in the pressing device at one end facing away from bending surfaces 19, 20. The fastening mechanisms 25, 26 may, for example, be rectangular shaped grooves inserted on both sides in the relevant end of the upper and lower tools 17, 18. The grooves may also be designed as a dovetail groove to guarantee a sufficiently tight fit in the pressing device in the vertical direction without further fastening elements, for example clamping screws or the like.

The upper tool 17 and the lower tool 18 shown in the representation in FIG. 4 serve exclusively to form the rectilinear (flat, superficial) stringer leg on the steel sheet blank in a second forming step with which the clip is then completed.

Figure 5:
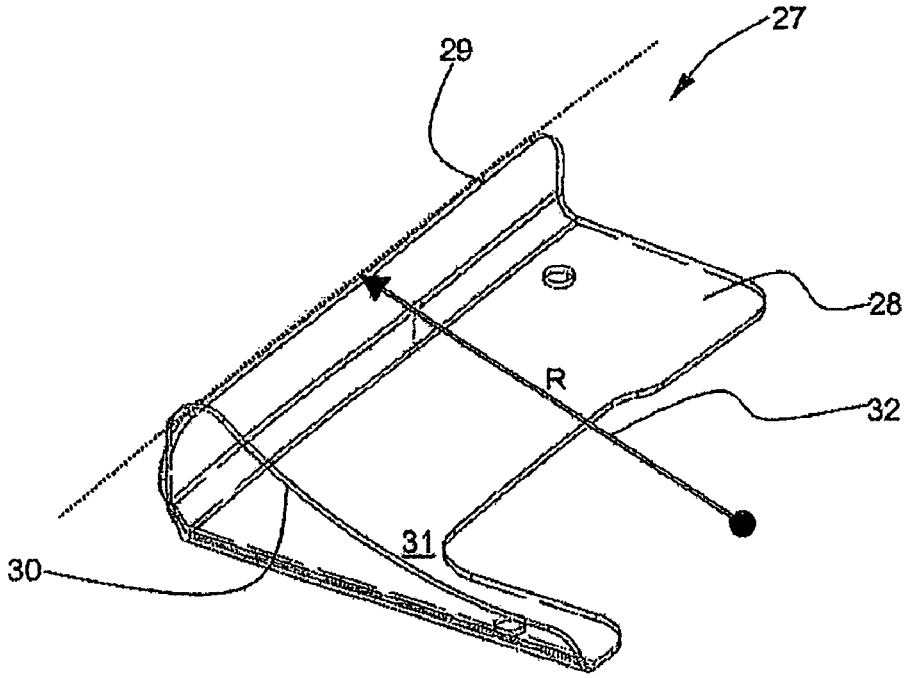
FIG. 5 is a perspective view of the sheet blank formed for the clip.

FIG. 5 shows, in a perspective view, a clip 27 formed by means of curved top upper and lower tools 1, 2 (cf. FIGS. 1-3) and by means of rectilinear upper and lower tools 17, 18 (cf. FIG. 4).

In a fuselage barrel of an aircraft, clip 27 serves to connect stringers, annular ribs and the fuselage cell skin. Clip 27 is produced in two single stroke forming steps in a pressing device, not shown, with the aid of curved upper and lower tools 1, 2 and the rectilinear upper and lower tools 17, 18 from a flat, cut to length, edge machined steel sheet blank 28 of an aluminum alloy material. The aluminum alloy material is, for example, a highly formable T351/HFT4 aluminum alloy material (so-called HF material, "high formability material").

A curved planking element 29 is preferably formed in one (press) stroke by surface model forming by means of curved upper and lower tools 1, 2, whilst a rectilinear stringer element 30 is preferably formed in one stroke by conventional bending with the rectilinear upper and lower tools 17, 18. Both the (slightly) curved planking element 29 and the straight (flat) stringer element 30 form an angle of approximately 90° with an upper side 31 of steel sheet blank (28). The slight curvature 32 of curved planning element 29 is adapted to an individual diameter or radius R of a fuselage barrel in which clip 27 is used to guarantee as full a contact as possible between planking element 29 and the fuselage cell skin, not shown.

Figure 6:
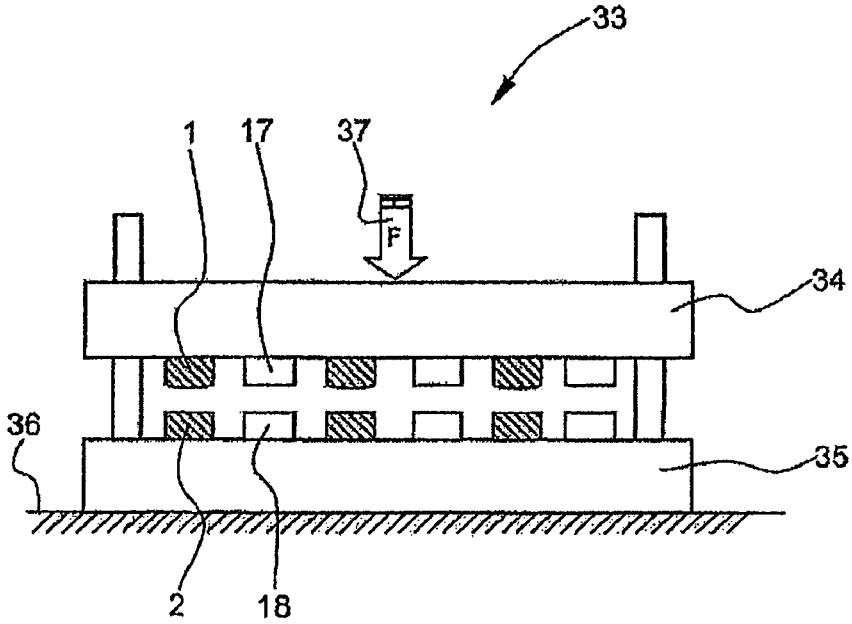
FIG. 6 is a diagrammatic view of a pressing tool with three curved upper and lower tools and three rectilinear upper and lower tools.

FIG. 6 shows a highly schematic representation of a pressing device.

A pressing device 33 has an upper tool support 34 and a lower tool support 35. The lower tool support 35 rests solidly on a base surface 36. The upper tool support 34 can be lowered onto the lower tool support 35 by means of a hydraulic drive, for example, not shown, a strong mechanical pressing force 37 acting between the upper and lower tool supports 34, 35. A further two curved upper and lower tools, and further rectilinear two upper and lower tools which, for better clarity of the drawing do not bear reference numbers, are generally arranged on tool supports 34, 35.

In pressing device 33 shown, six steel sheet blanks can be formed simultaneously. The curved planking element is formed in a first forming step by means of curved upper and lower tools 1, 2. Pressing device 33 is then retracted and the steel sheet blanks removed from the curved upper and lower tool and inserted in the corresponding rectilinear upper and lower tools. The rectilinear stringer element is then formed in a second forming step.

Figure 7:
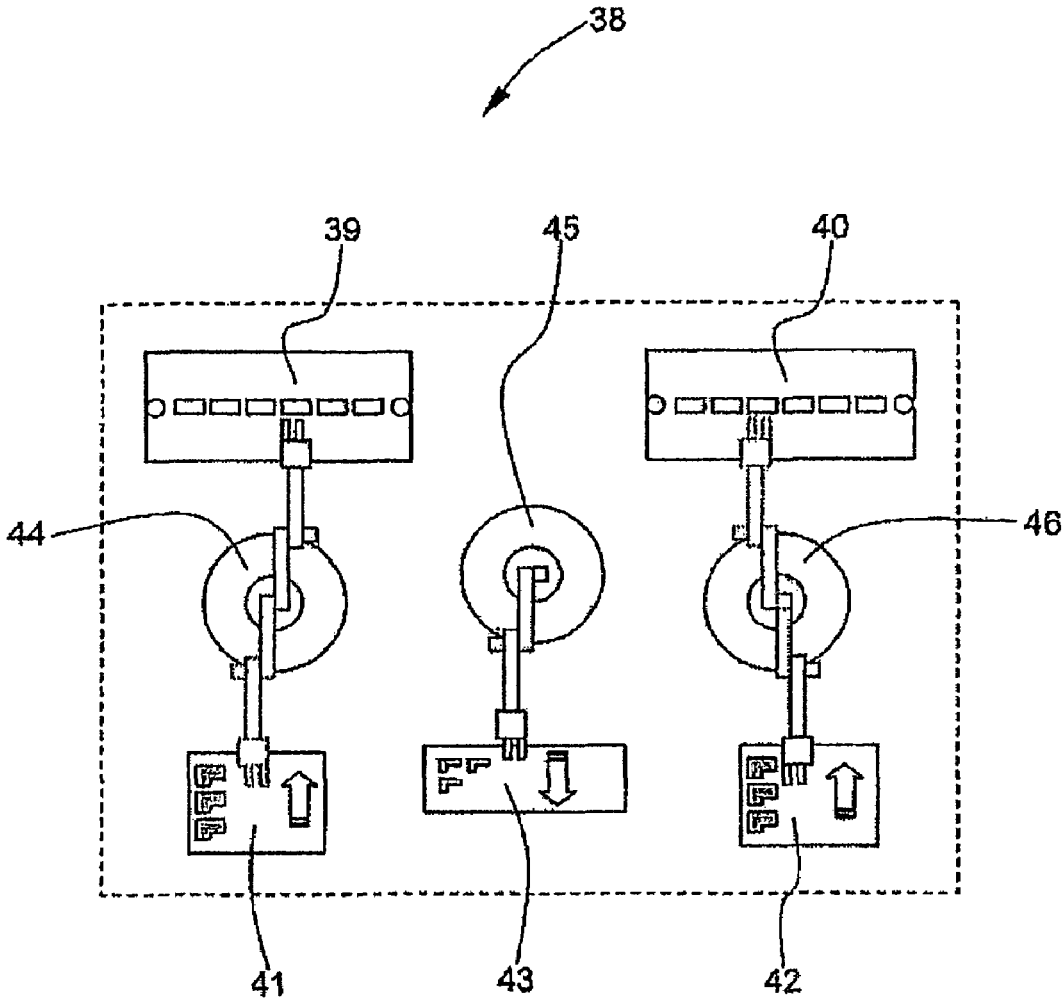
FIG. 7 is a diagrammatic representation of a production cell for producing clips from sheet blanks with two pressing devices for forming.

FIG. 7 shows diagrammatically the structure of a production cell with two pressing devices for fully automatic production of the clips.

Production cell 38 for carrying out the inventive method comprises, among other things, pressing devices 39, 40, feed magazines 41, 42 for the ordered supply of steel sheet blanks, extraction magazine 43 for the defined deposition of the steel sheet blanks formed into clips, and three articulated arm robots 44, 45, 46 in order to position the steel sheet blanks inside production cell 38. The steel sheet blanks and finished clips in the two feed magazines 41, 42 and the extraction magazine 43 are not provided with reference numbers for greater clarity in the drawing.

The articulated arm robots 44, 46 serve mainly to feed the steel sheet blanks, still flat, from feed magazines 41, 42 into the assigned pressing device 39, 40. In addition the steel plate are transferred between the first and second forming steps in the assigned pressing device 39, 40 ("tool change") by means of articulated arm robots 44, 46. The third articulated arm robot 45 serves primarily to remove the steel bar plates formed completely into a clip after the second forming step from one of the two pressing devices 39, 40. Instead of articulated arm robots shown and described in FIG. 7, any other fully automatic handling devices may be used inside production cell 38 to move and position the steel sheet blanks, the steel sheet blanks already formed and the finished clips between feed magazines 41, 42, pressing devices 39, 40 and extraction magazine 43.

The inventive method is divided into the following work steps:

The steel sheet blank 28 is first punched or cut out of an aluminum alloy plate or contoured in another manner and machined on the edge side. These production steps are carried out outside production cell 38. The curved planking element 29 is formed in a first forming step by means of upper and lower tools 1, 2 in one stroke by the so-called surface model forming process. The rectilinear stringer element 30 is formed in the second forming step by means of the rectilinear upper and lower tools 17, 28 by means of the surface model forming process to complete clip 27. It is also possible to carry out the forming steps in the reverse order.

Heat treatment of the steel bar plate 28 before the forming process is no longer required. In addition, the material does not recoil because of the special tool geometry used ("convexity surfaces", spherically curved tool surfaces), with the result that "overbending" of the component previously often required, i.e. forming the component beyond a theoretical degree of deformation, is no longer required.

The aluminum alloy material may be a highly formable and high strength T351/HFT 4 alloy, for example. Other aluminum alloys having equivalent and adequate mechanical strengths may also be used as a basic material for the steel sheet blanks.

Although modifications and changes may be suggested by those skilled in the art, it is the intention of the inventors to embody within the patent warranted hereon all changes and modifications as reasonably and properly come within the scope of their contribution to the art.

What is claimed is:

1. A pressing device for forming steel sheet blanks into clips, which comprise curved planking elements and rectilinear stringer elements, for connecting a fuselage cell skin to a stringer and to an annular rib in an aircraft fuselage, comprising:

at least one curved upper tool;

at least one curved lower tool;

at least one rectilinear upper tool;

at least one rectilinear lower tool;

wherein the upper and lower curved tools each have an approximately V-shaped cross-sectional geometry that varies in the longitudinal direction of the upper and lower curved tools, thereby forming upper and lower convexity surfaces; and wherein the upper and lower convexity surfaces are designed to essentially correspond to each other in order to form curved planking elements, and the at least one rectilinear upper tool and the at least one rectilinear lower tool each comprise an upper and lower bending surface designed to correspond to each other in order to form the rectilinear stringer elements.

2. The pressing device of claim 1, comprising at least three curved upper and lower tools and at least three rectilinear upper and lower tools.

3. The pressing device of claim 1, wherein each of the upper convexity surfaces comprises a height curve and each of the lower convexity surfaces comprises a base curve, a surface model of at least one of the height curve or the base curve essentially corresponding to a curvature of the planking element.

4. The pressing device of claim 1, wherein the upper bending surfaces and the lower bending surfaces comprise an essentially V-shaped cross-sectional geometry.

5. The pressing device of claim 1, wherein the steel sheet blank is formed with a high formable aluminum alloy.

6. The pressing device of claim 5, wherein the aluminum alloy is a T351/HFT 4 aluminum alloy.

7. A pressing device for forming steel sheet blanks into clips, which comprise curved planking elements and rectilinear stringer elements, for connecting a fuselage cell skin to a stringer and to an annular rib in an aircraft fuselage, comprising:

at least one curved upper tool;

at least one curved lower tool;

at least one rectilinear upper tool;

at least one rectilinear lower tool; and wherein the upper and lower curved tools each have an approximately V-shaped cross-sectional geometry that varies in the longitudinal direction of the upper and lower curved tools, thereby forming upper and lower convexity surfaces.

* * * * *